US006709148B2

(12) United States Patent
Glass

(10) Patent No.: US 6,709,148 B2
(45) Date of Patent: Mar. 23, 2004

(54) ADAPTERS FOR MOUNTING CONTAINERS ON A SHAKER

(75) Inventor: Gerald Glass, Springfield, MO (US)

(73) Assignee: Mono Equipment Co., Inc., Springfield, MO (US)

( * ) Notice: Subject to any disclaimer, the term of this patent is extended or adjusted under 35 U.S.C. 154(b) by 99 days.

(21) Appl. No.: 10/145,689

(22) Filed: May 16, 2002

(65) Prior Publication Data

US 2003/0214876 A1 Nov. 20, 2003

(51) Int. Cl.[7] ..... B01F 11/00; B01F 15/00
(52) U.S. Cl. ..... 366/110; 366/111; 366/209
(58) Field of Search ..... 366/110–112, 114, 366/208–216, 219, 349, 602, 605

(56) References Cited

U.S. PATENT DOCUMENTS

| | | | | | |
|---|---|---|---|---|---|
| 2,060,932 | A | * | 11/1936 | Friermood | 366/211 |
| 2,109,233 | A | | 2/1938 | Jorgenson | |
| 2,151,123 | A | | 3/1939 | Lavine | |
| 2,599,833 | A | | 6/1952 | Holmlund | |
| 2,610,041 | A | | 9/1952 | Stahl | |
| 3,090,604 | A | * | 5/1963 | Wheeler | 366/213 |
| 3,735,964 | A | | 5/1973 | Lorenzen | |
| 4,090,612 | A | * | 5/1978 | Lostutter | 366/214 |
| 4,133,466 | A | * | 1/1979 | Rosen | 366/212 |
| 4,318,622 | A | * | 3/1982 | Sterrenberg | 366/110 |
| 4,398,829 | A | * | 8/1983 | Shick | 366/110 |
| 4,523,855 | A | | 6/1985 | Walker | |
| 4,662,760 | A | | 5/1987 | Powell | |
| 4,893,938 | A | | 1/1990 | Anderson | |
| 5,050,996 | A | | 9/1991 | Allen | |
| 5,439,287 | A | | 8/1995 | Roepke, Sr. | |
| 5,593,228 | A | * | 1/1997 | Tannenbaum | 366/209 |
| 6,302,575 | B1 | * | 10/2001 | Anderson et al. | 366/349 |

FOREIGN PATENT DOCUMENTS

DE 4304049 A1 * 8/1994

* cited by examiner

*Primary Examiner*—Charles E. Cooley
(74) *Attorney, Agent, or Firm*—Nixon & Vanderhye

(57) ABSTRACT

Adapters are provided for opposed cradle heads of a shaker arm for mounting a plurality of containers of different sizes. The cradle heads are provided with arcuate grooves and flanges in opposition to one another and the adapters are provided with bases having complementary arcuate grooves and flanges. With the adapters mounted on the cradle heads with interfitting grooves and flanges, multiple containers are disposed in container end supports in the adapters whereby oscillatory movement of a shaker arm oscillates the cradle heads, adapters and containers.

18 Claims, 8 Drawing Sheets

ADAPTERS FOR MOUNTING CONTAINERS ON A SHAKER

BACKGROUND OF THE INVENTION

The present invention relates to apparatus for mounting one or more containers on an arm of a shaker for shaking the containers and their contents and particularly relates to one or more sets of adapters for mounting on cradle heads of a shaker for shaking one or more containers carried by the adapters on the cradle heads.

Shakers having cradle heads for oscillatory movement are well known. In shakers of this type, an electric motor oscillates a shaker arm on which is mounted a pair of cradle heads. The cradle heads are generally mounted on slides for movement toward and away from one another so that containers of different sizes can be disposed on and mounted between the spaced cradle heads. In one form of prior cradle head, a plurality of fingers project outwardly from each head and have reversely turned flanges for gripping the ends of a container such as a paint can. While shakers of this type have proved eminently useful, they have not heretofore been specifically adapted for shaking a plurality of containers or containers of various sizes. Accordingly, there has developed a need for a shaking apparatus which can be adapted to shake a plurality of containers of different sizes and configurations.

BRIEF DESCRIPTION OF THE INVENTION

In accordance with a preferred embodiment of the present invention, there is provided one or more sets of adapters for mounting on modified cradle heads of a conventional shaker so that one or more containers can be disposed between and supported by the adapters and shaken. To accomplish the foregoing, the cradle heads of a standard shaker are each modified to provide at least one of an arcuate projecting flange and an arcuate groove, and preferably both. One or more sets of adapters each including a pair of adapters are also provided. Each adapter of each set includes a mounting base having at least one of an arcuate groove and arcuate flange, preferably both, corresponding with the arcuate flange and groove, respectively, of the cradle heads.

Upstanding portions of the adapters from their mounting bases include one or more recesses serving as supports for the ends of containers disposed between the adapters. The recesses of the one or more of the adapters may have a through opening to accommodate smaller diameter projections on the containers, e.g., spray nozzle heads or caps sealing the containers. With a matched set of adapters upstanding from the cradle heads, it will be appreciated that the containers can be supported between the adapters with the containers being shaken by the oscillatory motion of the cradle heads mounted on the shaker. A set of adapters may also include a spacer extending between registering recesses of the opposed adapters. The spacer facilitates support of the adapters and also includes openings at one end or both ends to receive smaller containers such as vials for shaking.

In another preferred embodiment of the present invention, an adapter is provided for mounting between the cradle heads, the adapter supporting a tray which, in turn, supports a plurality of containers. The tray has conventional container supports along an upper side thereof. The adapter is mounted along the underside of the tray. The adapter has arcuate ends for reception in the arcuate grooves of the cradle heads whereby the adapter and tray are mounted to the shaker for shaking the containers carried by the tray.

In a preferred embodiment according to the present invention, there is provided apparatus for mounting one or more containers on an arm of a shaker wherein the arm is mounted for oscillatory movement comprising a cradle carried by the shaker arm for oscillatory movement therewith, the cradle including a pair of cradle heads spaced from one another and mounted for movement toward and away from one another, one of the cradle heads including one of an arcuate groove and an arcuate flange facing another of the cradle heads, a pair of adapters for mounting to the cradle heads, respectively, one of the adapters having one of an arcuate flange and an arcuate groove, the one arcuate groove and arcuate flange of the one cradle head and the one arcuate flange and arcuate groove of the one adapter interfitting with one another, respectively, joining the one adapter and the one cradle head to one another and each adapter having at least one container end support for mounting a container therebetween enabling the one container for oscillatory movement with the shaker arm.

In a further preferred embodiment according to the present invention, there is provided apparatus for mounting one or more containers on an arm of a shaker wherein the arm is mounted for oscillatory movement comprising a cradle carried by the arm for oscillatory movement therewith, the cradle including a pair of cradle heads spaced from one another and mounted for movement toward and away from one another, each cradle head including an arcuate groove in spaced opposition to one another and an adapter carried by each cradle head having one or more supports for carrying one or more container ends, the adapters including projecting arcuate flanges for reception within the arcuate grooves of the cradle heads, respectively.

In a further preferred embodiment according to the present invention, there is provided apparatus for mounting one or more containers on an arm of a shaker wherein the arm is mounted for oscillatory movement comprising a cradle carried by the arm for oscillatory movement therewith, the cradle including a pair of cradle heads spaced from one another and mounted for movement toward and away from one another, each cradle head including an arcuate flange in spaced opposition to one another and an adapter carried by each cradle head having supports for carrying one or more container ends, the adapters including arcuate grooves for receiving the arcuate flanges of the cradle heads, respectively.

In a further preferred embodiment according to the present invention, there is provided apparatus for mounting one or more containers on an arm of a shaker wherein the arm is mounted for oscillatory movement comprising a cradle carried by the arm for oscillatory movement therewith, the cradle including a pair of cradle heads spaced from one another and mounted for movement toward and away from one another, each cradle head including an arcuate groove facing in opposition to one another, an adapter for carrying the one or more containers, the adapter including a mounting member having arcuate flanges at opposite ends thereof for reception within the arcuate grooves of the cradle heads, respectively.

DETAILED DESCRIPTION OF THE INVENTION

Figure 1:
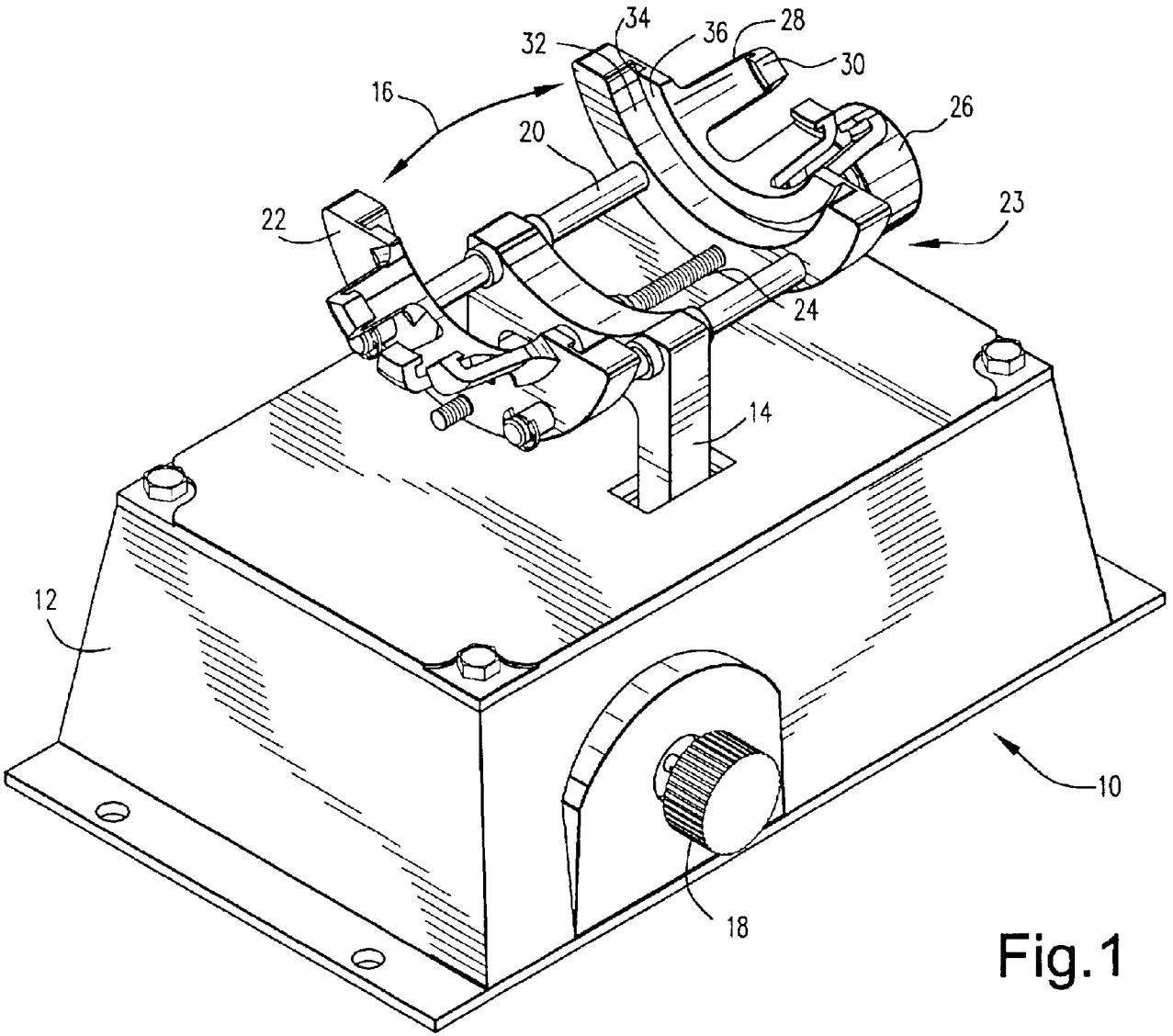
FIG. 1 is a perspective view of a shaker having cradle heads constructed in accordance with a preferred embodiment of the present invention.

Referring now to the drawings, particularly to FIG. 1, there is illustrated a shaker, generally designated 10, having a housing 12 within which is an electric motor, not shown, for oscillating an arm 14 back and forth in the direction of the arrows 16. As illustrated, the shaker 10 includes a timer which is adjustable by rotation of the knob 18 to control the duration of the shaking cycle. The mechanism for oscillating the arm 14 in the direction of the arrows 16 is conventional and further description thereof is not necessary. Suffice to say that the arm 14 oscillates for shaking a container mounted on the shaker.

The oscillatory arm 14 mounts a cradle, generally designated 23, including a pair of laterally spaced rods 20 projecting to opposite sides of arm 14. A pair of cradle heads 22 are slidably carried on the rods 20 on opposite sides of the arm 14. A central threaded rod 24 threadedly engages with each of the cradle heads 22 and has reverse threads on opposite sides of the arm 14. The threaded rod 24 includes a knob 26 for manual rotation of the rod. Rod 24 is also fixed against axial movement relative to the arm 14. By rotation of the knob 26, the reversely threaded portions of the rod 24 enable the cradle heads 22 to be displaced toward and away from one another.

Each of the cradle heads 22 includes a plurality of elongated fingers 28 terminating at distal ends in reversely bent flanges 30. The flanges 30 on each cradle head 22 project toward the opposite cradle head defining lips. The lips on the fingers 28 are utilized to secure opposite ends of a container, for example, a can, to the shaker, enabling the arm 14 and cradle heads 22 to oscillate the can and shake its contents. In prior cradle heads, the arcuate surface 32 of each cradle head 22 included a flat end face inwardly of the fingers 28. In accordance with the present invention, the end face of each cradle head is provided with one of a groove 34 and a projecting flange 36, preferably both. Thus, the arcuate grooves 34 of the cradle heads lie in registration with one another and the flanges 36 radially inwardly of the grooves 34 lie in registration one with the other. The grooves 34 and flanges 36 lie in partial concentricity with one another and facilitate securement of adapters to the shaker, enabling the shaker to simultaneously mount one or more containers and containers of different sizes, as will now be described.

Figure 2:
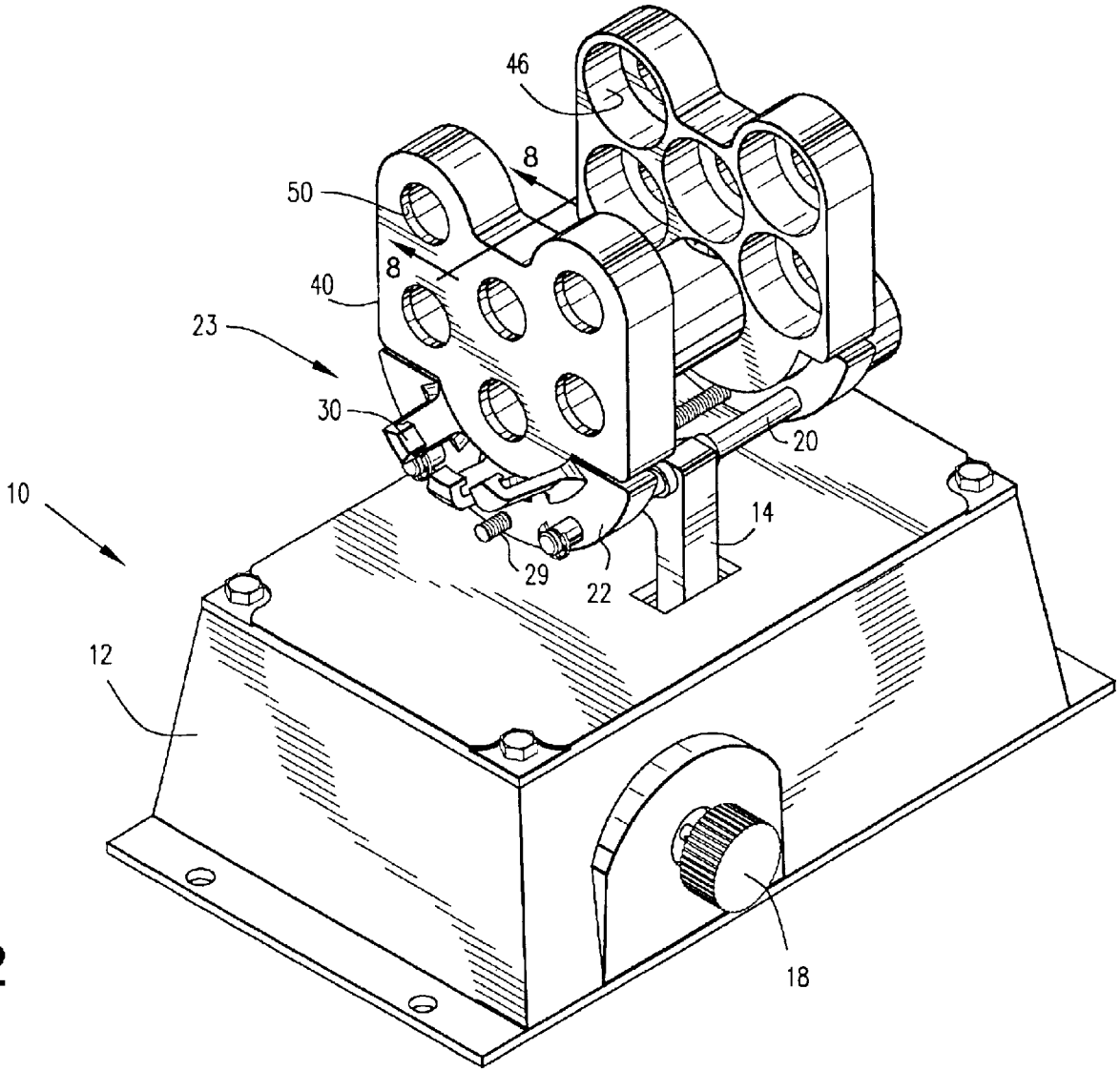
FIG. 2 is a view similar to FIG. 1 with adapters mounted on the cradle heads of the shaker.
Figure 4:
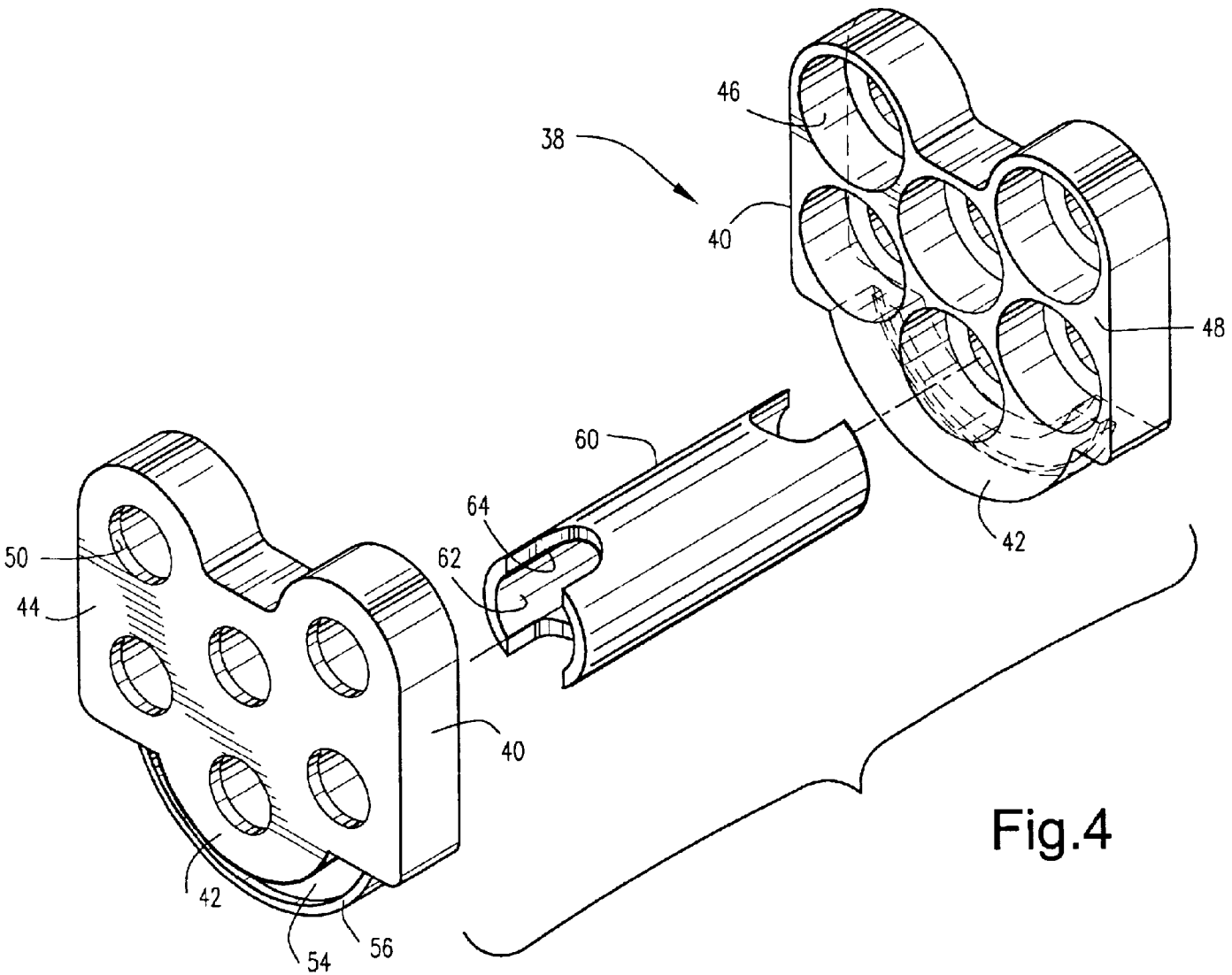
FIG. 4 is an exploded perspective view of the adapters with a spacer therebetween.

As best illustrated in FIGS. 2 and 4, a set of adapters, generally indicated 38, are provided for mounting on the shaker 10. Particularly, each adapter 40 includes a base portion 42 for mounting the adapter to a cradle head and an upstanding portion 44 carrying one or more supports for supporting ends of containers disposed between the adapters 40. In a particular and preferred embodiment of the present invention, each adapter 40 has one or more recesses 46 opening through an inside face 48 thereof for receiving and supporting ends of containers disposed between the adapters. One or more of the recesses 46 may also have reduced openings 50 whereby the recess 46 and opening 50 form an aperture through the adapter. The openings 50 accommodate reduced diameter end portions on containers, for examples, caps, spray nozzles and the like. In the illustrated adapters 38, six recesses 46 and six openings 50 are provided at laterally and vertically spaced positions relative to one another. It will be appreciated that the adapters 40 are formed of a plastic material and that different numbers of recesses and openings may be formed in the adapters and in various arrangements and configurations thereof whereby adapters can be formed for specific applications and sizes of containers.

Figure 8:
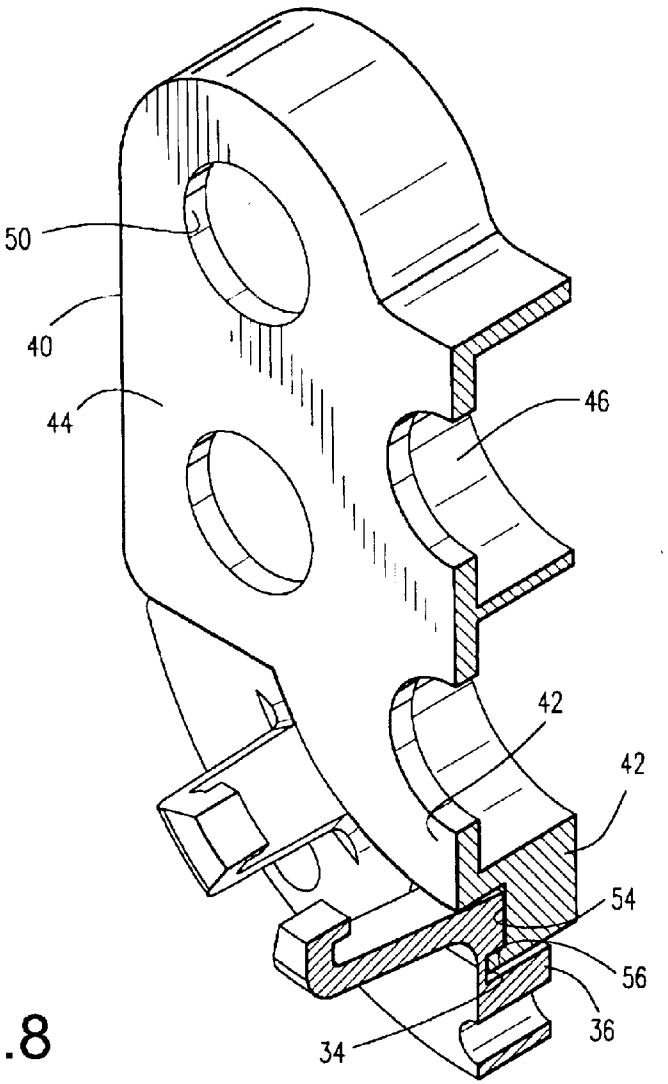
FIG. 8 is an enlarged cross-sectional view thereof taken generally about on line 8—8 in FIG. 2.

The base of each of the adapters 40, as best illustrated in FIGS. 4 and 8, the arcuate base portion 42 corresponds in shape to the arcuate surface 32 of the cradle head. The base portion 42 also includes an arcuate recess 54 and an outwardly extending arcuate flange 56 in partial concentricity with one another. It will be appreciated that the arcuate recess 54 and arcuate flange 56 on each adapter registers with and is complementary to the arcuate flange 36 and arcuate recess 34 on the cradle head. Also, with this configuration, the base portion 42 of the adapter 40 can be mated to the arcuate portion of the cradle head and maintained in an upright position, as illustrated in FIG. 2.

Figure 3:
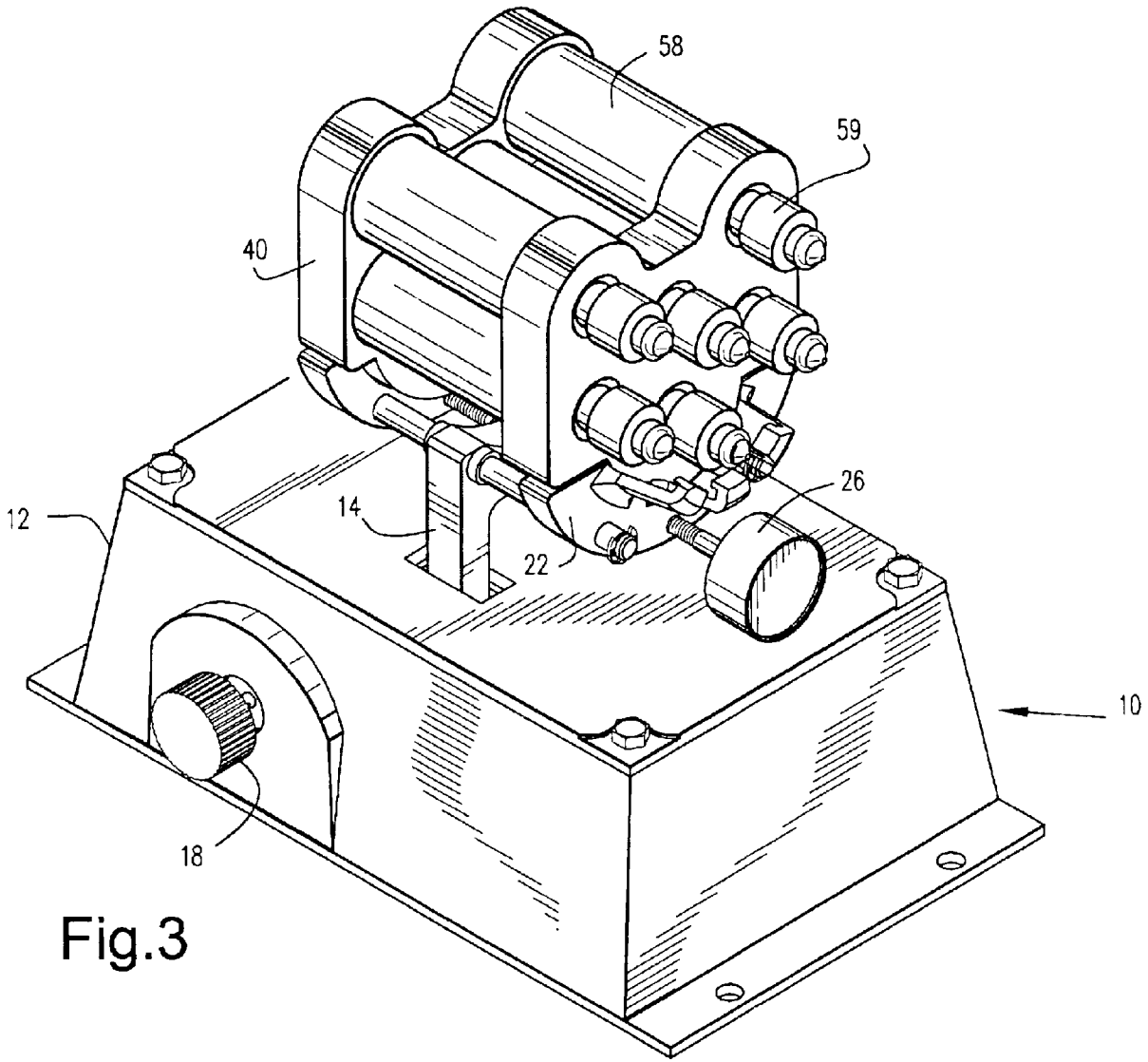
FIG. 3 is a perspective view similar to FIG. 2 illustrating the adapters on the cradle heads with containers between the adapters.

With the adapters 40 in place, seated on the cradle heads, and with containers 58 (FIG. 3) disposed between the adapters 40, the arm 14 causes the cradle heads 22 and, in turn, the adapters 40 and containers 8 carried therebetween, to oscillate. From a review of FIG. 3, it will be appreciated that the containers may have projecting end portions 59 which project through the openings 50 of the recesses 46.

Referring to FIG. 4, a spacer 60 may also be provided for extension between the adapters 40. The spacer 60 comprises a cylindrical sleeve having a solid mid-portion and cylindrical recesses 62 at opposite ends. Additionally, diametrically opposed slots 64 are formed in each of the opposite ends of the spacer 60. The slots 64 may receive small containers, e.g., vials, for shaking. When spacer 60 is installed between the adapters 40 with the spacer ends received in the recesses 46 of adapters 40, the slots 64 are partially closed to confine the vials within the ends of the spacer. Thus, small vials, together with larger size containers, may be shaken simultaneously using the adapters 40 and spacer 60 mounted on the cradle heads.

Figure 5:
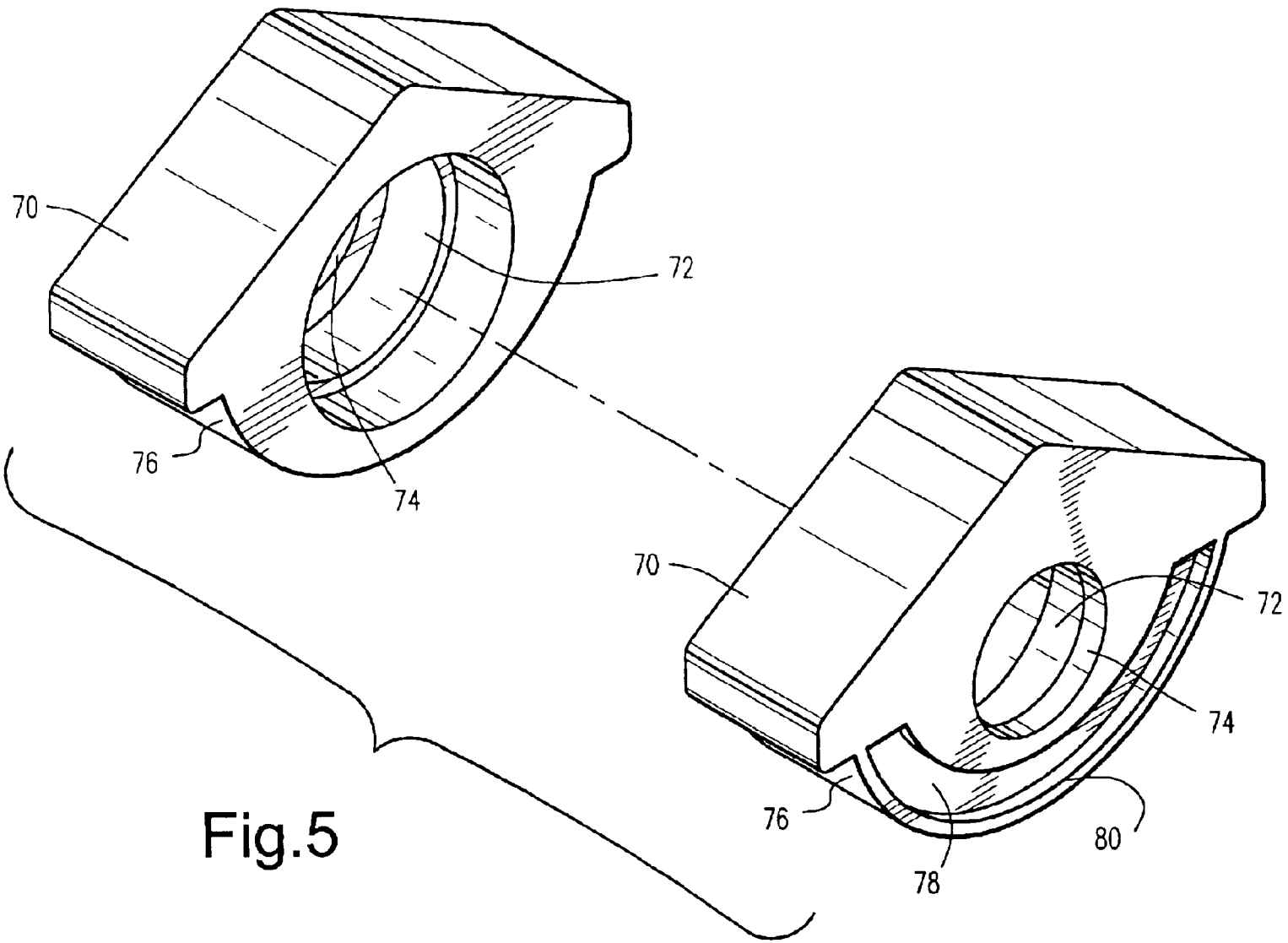
FIG. 5 is a perspective view of another set of adapters.

Referring now to FIG. 5, there is illustrated adapters 70 of another set of adapters. Each adapter 70 has a single recess 72 and opening 74 similar to the recesses 36 and openings 50 of adapters 40. Additionally, each of the adapters 70 of the pair thereof includes a base 76 having an arcuate groove 78 and an arcuate flange 80 complementary to the groove 34 and flange 36 of the cradle heads 22 whereby the adapters 70 are mounted to the cradle heads similarly as adapters 40. It will be appreciated that the sets of adapters 40 and 70 are two of a large number of differently sized and configured sets of adapters which may be provided for shaking one or more different sized and configured containers.

Figure 6:
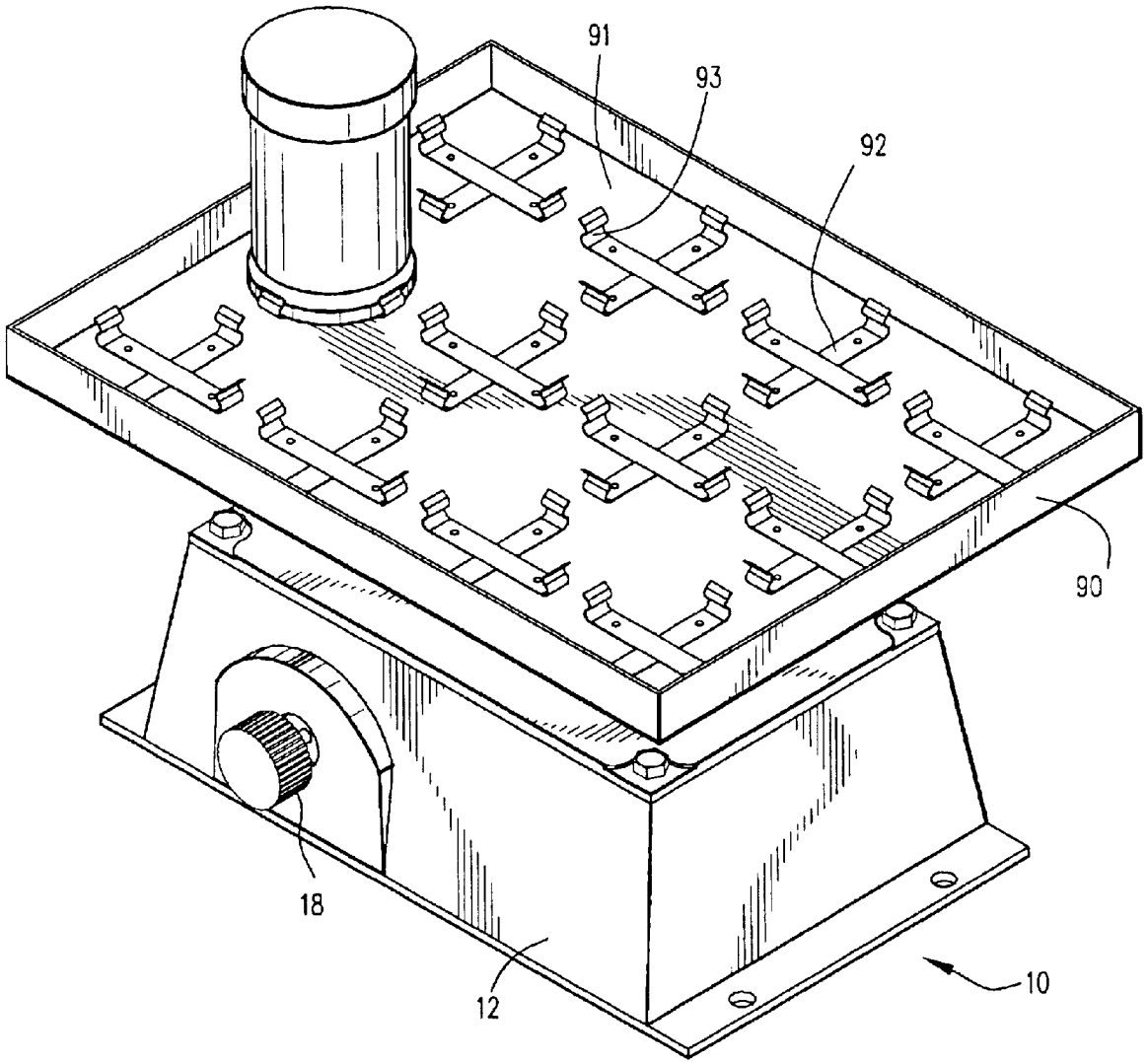
FIG. 6 is a perspective view illustrating a tray for containing a plurality of containers mounted on the shaker employing an adapter of a further embodiment hereof.
Figure 7:
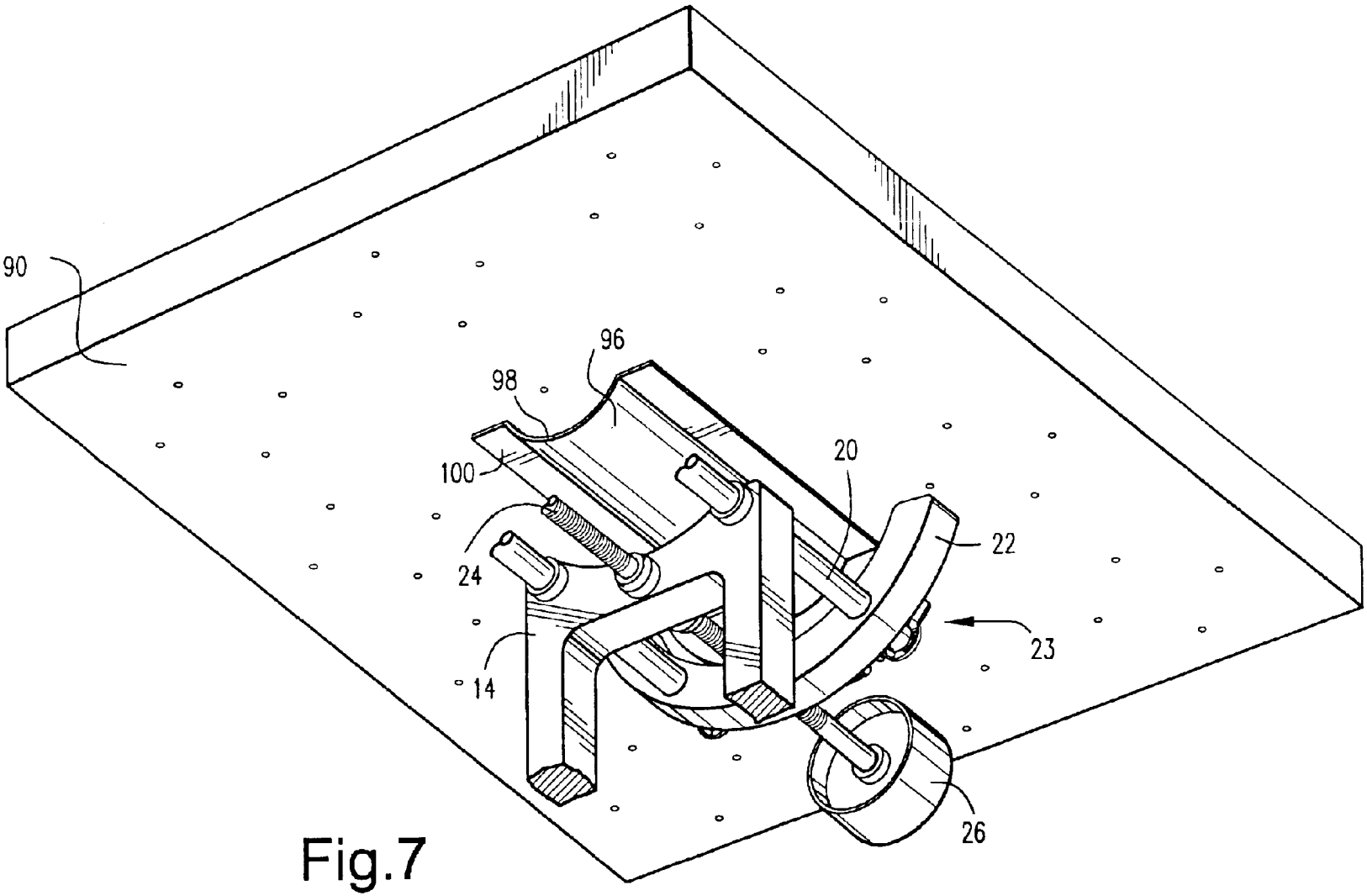
FIG. 7 is a perspective view of the underside of the tray of FIG. 6 illustrating the adapter mounting the tray to the shaker.

Referring now to FIGS. 6 and 7, the shaker 10 is illustrated with a tray 90 mounted on the cradle heads 22. The tray 90 has an upper surface 91 to which is secured a plurality of spring clips 92 having flanges 93 formed at their tips for grasping the lower ends of containers or vials disposed on the tray 90. It will be appreciated that multiple spring clips 92 are arranged on the tray 90 to secure a plurality of containers or vials to the tray, e.g., twelve container positions being illustrated, whereby the oscillatory movement of the cradle heads 22 shakes the containers mounted on the tray 90.

Referring to FIG. 7, the tray 90 includes a mounting adapter 96 for releasably securing the tray to the cradle heads 22. The adapter 96 comprises an arcuate elongated sleeve having arcuate edges or flanges 98 at opposite ends. A pair of side flanges 100 secure, for example, by welding, the adapter 96 to the tray 90. By first spreading the cradle heads 22 away from one another, e.g., by rotating knob 26, the ends 98 of the sleeve 96 can be disposed on the arcuate surfaces 32. By rotating the knob 26 in an opposite direction, the cradle heads 22 are driven toward one another, capturing the ends or flanges 98 of sleeve 96 within the grooves 34 of the cradle heads whereby the tray is releasably secured to the cradle heads. With the tray releasably secured thereto, the arm 14 is oscillated, shaking the one or more containers or vials mounted on the tray 90.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for mounting one or more containers on an arm of a shaker wherein the arm is mounted for oscillatory movement comprising:

a cradle carried by the shaker arm for oscillatory movement therewith;

said cradle including a pair of cradle heads spaced from one another and mounted for movement toward and away from one another;

one of said cradle heads including one of an arcuate groove and an arcuate flange facing another of said cradle heads;

a pair of adapters for mounting to said cradle heads, respectively;

one of said adapters having one of an arcuate flange and an arcuate groove, said one arcuate groove and arcuate flange of said one cradle head and said one arcuate flange and arcuate groove of said one adapter interfitting with one another, respectively, joining said one adapter and said one cradle head to one another; and each said adapter having at least one container end support for mounting a container therebetween enabling the one container for oscillatory movement with the shaker arm.

2. Apparatus according to claim 1 wherein said one cradle head includes another of said arcuate groove and arcuate flange, said arcuate groove and said arcuate flange of said one cradle head lying in side-by-side relation to and in partial concentricity with one another, said one adapter including another of said arcuate groove and arcuate flange, said arcuate groove and said arcuate flange of said one adapter lying in side-by-side relation to and in partial concentricity with one another, said one cradle head and said one adapter interfitting with one another with the flange of said one cradle head received within the groove of said one adapter and the flange of said one adapter received within the groove of said one cradle head.

3. Apparatus according to claim 1 wherein said one container end support of said one adapter includes an opening through said adapter for receiving an end projection of the one container disposed between the adapters.

4. Apparatus according to claim 1 wherein each said adapter has a plurality of container end supports in respective opposition to one another for locating plural containers between said adapters.

5. Apparatus according to claim 1 wherein a second of said cradle heads includes one of an arcuate groove and an arcuate flange facing said one cradle head, a second of said adapters including one of an arcuate flange and an arcuate groove, said one of said arcuate groove and arcuate flange of said second cradle head and said one arcuate flange and arcuate groove of said second adapter interfitting with one another joining said second adapter and said second cradle head to one another.

6. Apparatus according to claim 5 wherein said one cradle head includes another of said arcuate groove and arcuate flange, said arcuate groove and said arcuate flange of said one cradle head lying in side-by-side relation to and in partial concentricity with one another, said one adapter including another of said arcuate groove and arcuate flange, said arcuate groove and said arcuate flange of said one adapter lying in side-by-side relation to and in partial concentricity with one another, said one cradle head and said one adapter interfitting with one another with the flange of said one cradle head received within the groove of said one adapter and the flange of said one adapter received within the groove of said one cradle head, said second cradle head including another of said arcuate groove and arcuate flange, said arcuate groove and said arcuate flange of said second cradle head lying in side-by-side relation to and in partial concentricity with one another, said second adapter including another of said arcuate groove and arcuate flange, said arcuate groove and said arcuate flange of said second adapter lying in side-by-side relation to and in partial concentricity with one another, said second cradle head and said second adapter interfitting with one another with said flange of said second cradle head being received within the groove of said second adapter and the flange of said second adapter being received within the groove of said second cradle head.

7. Apparatus according to claim 6 wherein each said adapter has a plurality of container end supports in respective opposition to one another for locating plural containers between said adapters.

8. Apparatus for mounting one or more containers on an arm of a shaker wherein the arm is mounted for oscillatory movement comprising:

a cradle carried by said arm for oscillatory movement therewith;

said cradle including a pair of cradle heads spaced from one another and mounted for movement toward and away from one another, each said cradle head including an arcuate groove in spaced opposition to one another; and an adapter carried by each cradle head having one or more supports for carrying one or more container ends, said adapters including projecting arcuate flanges for reception within the arcuate grooves of said cradle heads, respectively.

9. Apparatus according to claim 8 wherein each of said adapters includes at least one opening for carrying an end projection of a container disposed between said adapters.

10. Apparatus according to claim 8 including a spacer extending between said adapters and carried thereby.

11. Apparatus according to claim 8 including another pair of adapters having one or more supports and configured differently than the first mentioned adapters, each of said another pair of adapters including projecting arcuate flanges for reception within the arcuate grooves of said cradle heads, respectively.

12. Apparatus for mounting one or more containers on an arm of a shaker wherein the arm is mounted for oscillatory movement comprising:

a cradle carried by said arm for oscillatory movement therewith;

said cradle including a pair of cradle heads spaced from one another and mounted for movement toward and away from one another, each said cradle head including an arcuate flange in spaced opposition to one another; and an adapter carried by each cradle head having supports for carrying one or more container ends, said adapters including arcuate grooves for receiving the arcuate flanges of said cradle heads, respectively.

13. Apparatus according to claim 12 wherein each of said adapters includes at least one opening for carrying an end projection of a container disposed between said adapters.

14. Apparatus according to claim 13 including a spacer extending between said adapters and carried thereby.

15. Apparatus according to claim 12 including another pair of said adapters having one or more supports and configured differently than the first mentioned adapters, each of said another pair of adapters having at least one container end support and including an arcuate groove for receiving the arcuate flange of said cradle head.

16. Apparatus for mounting one or more containers on an arm of a shaker wherein the arm is mounted for oscillatory movement comprising:

a cradle carried by said arm for oscillatory movement therewith;

said cradle including a pair of cradle heads spaced from one another and mounted for movement toward and away from one another, each said cradle head including an arcuate groove facing in opposition to one another;

an adapter for carrying the one or more containers, said adapter including a mounting member having arcuate flanges at opposite ends thereof for reception within the arcuate grooves of said cradle heads, respectively.

17. Apparatus according to claim 16 including a tray carried by said mounting member, said tray including a plurality of mounting elements for releasably holding a plurality of containers on the tray.

18. Apparatus according to claim 17 wherein said adapter includes a pair of side flanges for securing the adapter to the tray.

* * * * *